United States Patent [19]

McKenna

[11] Patent Number: 4,697,815

[45] Date of Patent: Oct. 6, 1987

[54] DART

[75] Inventor: Arthur J. McKenna, Mississauga, Canada

[73] Assignee: 139316 Canada Inc, Mississauga, Canada

[21] Appl. No.: 889,542

[22] Filed: Jul. 25, 1986

[51] Int. Cl.[4] ..... A63B 65/02

[52] U.S. Cl. ..... 273/420

[58] Field of Search ..... 273/419, 420, 416; 30/164.6

[56] References Cited

U.S. PATENT DOCUMENTS

| | | | |
|---|---|---|---|
| 4,109,915 | 8/1978 | Bottelsen | 273/419 X |
| 4,230,322 | 10/1980 | Bottelsen | 273/420 |

FOREIGN PATENT DOCUMENTS

| | | | |
|---|---|---|---|
| 135316 | 11/1949 | Australia | 273/420 |
| 265306 | 6/1929 | Italy | 273/420 |
| 198201 | 5/1923 | United Kingdom | 273/420 |
| 740209 | 11/1955 | United Kingdom | 273/420 |

*Primary Examiner*—Paul E. Shapiro

*Attorney, Agent, or Firm*—Robert F. Delbridge; Arne I. Fors

[57] ABSTRACT

A dart has a cavity extending rearwardly from a front end of the main body for a predetermined distance to an end wall, and a point assembly comprises a collar detachably securable to the front end of the main body, the collar having an axially-extending aperture extending therethrough, and a point comprising an elongated shaft with a pointed front end, the shaft extending through the collar and having a forwardly tapering portion at least in the region of the collar. The forwardly tapering shaft portion engages a rear end of the collar in a forward position of the point relative to the body to limit forward movement of the point relative to the body and permitting the body and collar to move forwardly relative to the point, when the point hits the target, to cause the cavity end wall to engage a rear end of the point shaft and drive the pointed front end into the target and to permit rotation of the body relative to the point about its longitudinal axis.

3 Claims, 4 Drawing Figures

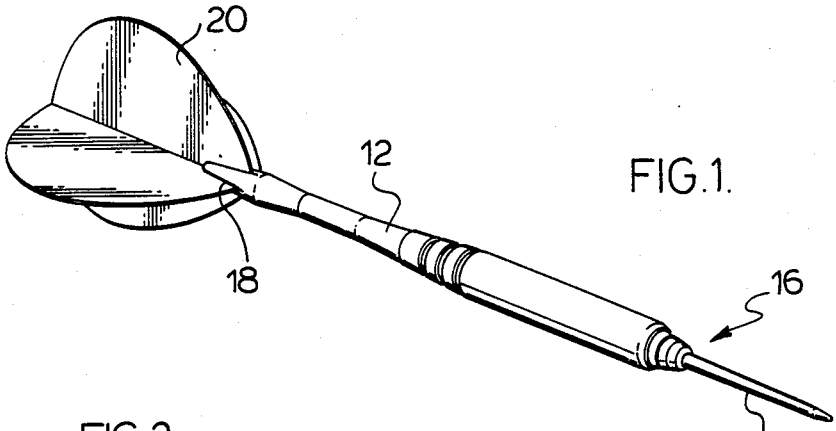
FIG. 1.
FIG. 2.
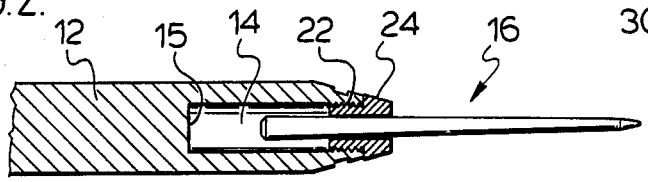
FIG. 3.
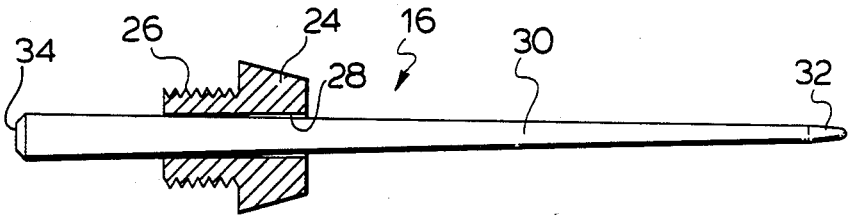
FIG. 4.
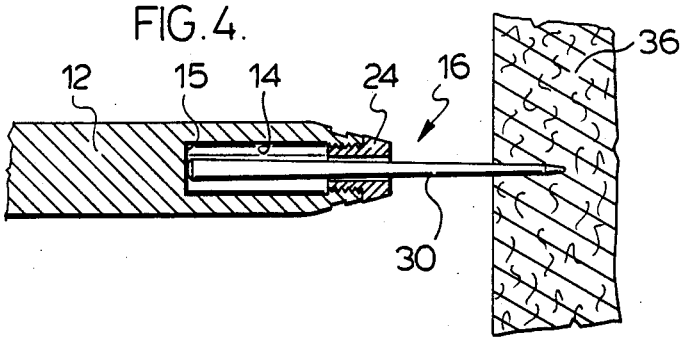

DART

This invention relates to darts.

It is known to provide a dart with a point having a shaft slidably mounted in a cavity at the front end of the main body of the dart such that, when the point hits the target, the main body moves forward relative to the point to cause the cavity end wall to hit the rear end of the point and drive the point into the target and so reduce the likelihood of the dart bouncing off the target. Such a dart is described in U.S. Pat. No. 4,230,322 (Bottelsen) issued Oct. 28, 1980.

However, known darts of this kind have somewhat complicated or unsatisfactory mechanisms for providing such a slideably moveable point, and it is therefore an object of the present invention to provide an improved slideably moveable point mechanism.

According to the invention, a point assembly comprises a collar detachably securable to the front end of the main body, the collar having an axially-extending aperture extending therethrough, and a point comprising an elongated shaft with a pointed front end, the shaft extending through the collar and having a forwardly tapering portion at least in the region of the collar. The forwardly tapering shaft portion engages a rear end of the collar in a forward position of the point relative to the body to limit forward movement of the point relative to the body and permits the body and collar to move forwardly relative to the point, when the point hits the target, to cause the cavity end wall to engage the rear end of the point shaft and drive the pivoted front end into the target and to permit rotation of the body relative to the point about its longitudinal axis.

The point mechanism of the present invention is simple and reliable. Also, the fact that the main body of the dart is capable of rotation relative to the point when the point has been driven into a target is of considerable advantage if a subsequently thrown dart hits the tail of the first dart. Instead of damaging and/or bouncing off the tail, the second dart can simply cause the tail of the first dart to rotate out of the way and accordingly provide only minimal impedence to the flight of the second dart.

The point shaft may be forwardly tapered over substantially all its length, and the means for receiving the point assembly may comprise a screw-thread in the body cavity, the collar having an external screw-thread engageable therewith to detachably secure the point assembly to the body.

One embodiment of the invention will now be described, by way of example, with reference to the accompanying drawings, of which:

FIG. 1 is a perspective view of a dart having a point assembly in accordance with the invention, FIG. 2 is a cross-sectional view of the dart with the point in a first position, FIG. 3 is an enlarged sectional view of the point assembly, and FIG. 4 is a view similar to FIG. 2 but showing the engagement of the cavity rear end wall with the rear end of the point shaft after the point has hit a target.

Referring to the drawings, a dart has a main body 12 which may be of a conventional type having a cavity 14 at the front end for receiving a point assembly 16 and slots 18 at the rear end receiving a tail 20 which may be of conventional kind. The collar 14 has a predetermined length terminating at a rear end wall, and has an internal screw-thread 22 adjacent its front end.

The point assembly 16 comprises a collar 24 having an external screw thread 26 adjacent its rear end engageable with the screw thread 22 in the cavity 14.

Collar 24 also has an aperture 28 extending therethrough, aperture 28 having a cylindrical wall parallel to the longitudinal axis of the dart. The point assembly 16 also includes a point 30 comprising an elongated shaft with a pointed front end 32 and a rear end 34. The point 30 is forwardly tapered over the whole length of the shaft.

FIG. 2 shows the point 30 in the throwing position, namely with the point 30 in a forward position relative to the collar 24 and the main body 12, with the point 30 engaging the rear end of the collar 24 with a slight wedging action at the rear end of aperture 28. The point 30 has lateral dimensions providing continuous peripheral spacing between the point 30 and the side wall of the cavity 14.

When the point 30 hits a target 36, as indicated in FIG. 4, the main body 12 and collar 24 move forwardly relative to the point 30 until the cavity end wall 15 engages the rear end 34 of the point 30 to further impel the point 30 into the target 36. Owing to the forward taper of the shaft of the point 30, there is now a slight clearance between the shaft and the collar 24 such that the collar 24, main body 12 and tail 20 can readily rotate relative to the point 30 about its longitudinal axis.

Thus, if a subsequently thrown dart hits the tail 20 of the dart already in the target, the tail 20 can be readily rotated by the second dart so as only to cause minimal impedence to its flight. There is also less likelihood of damage to the tail 20 and less likelihood of loosening or dislodgment of the first dart from the target 36.

The simplicity and reliability of the point mechanism of the present invention and its rotational advantages will be clearly apparent from the above description of a preferred embodiment. Other embodiments of the invention will be readily apparent to a person skilled in the art, the scope of the invention being defined in the appended claims.

I claim:

1. A dart comprising a main body having means at a forward end for receiving a point assembly and means at a rear end for receiving a tail, said point receiving means comprising a cavity extending rearwardly from a front end of the main body for a predetermined distance to an end wall, said point assembly comprising a collar detachably securable to the front end of the main body, said collar having an axially-extending aperture extending therethrough, and a point comprising an elongated shaft with a pointed front end, the shaft extending through the collar and having a forwardly tapering portion at least in the region of a rear end of the collar, said cavity having a side wall, and said shaft having lateral dimensions providing continous peripheral spacing between the shaft and the side wall of the cavity, the forwardly tapering shaft portion engaging the rear end of the collar in a forward position of the point relative to the body to limit forward movement of the point relative to the body and permitting the body and collar to move forwardly relative to the point, when the point hits the target, to cause the cavity end wall to engage a rear end of the point shaft and drive the pointed front end into the target and to permit rotation of the body relative to the point about its longitudinal axis.

2. A dart according to claim 1 wherein the point shaft is forwardly tapered for substantially all its length.

3. A dart according to claim 1 wherein the means for receiving the point assembly comprises a screw-thread in the body cavity, and said collar has an external screw-thread engageable therewith to detachably secure the point assembly to the body.

* * * * *